US009423734B2

(12) United States Patent
Ishida

(10) Patent No.: US 9,423,734 B2
(45) Date of Patent: Aug. 23, 2016

(54) FIXING DEVICE

(71) Applicant: Brother Kogyo Kabushiki Kaisha, Nagoya-shi, Aichi-ken (JP)

(72) Inventor: Kei Ishida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1 day.

(21) Appl. No.: 14/501,133

(22) Filed: Sep. 30, 2014

(65) Prior Publication Data

US 2015/0093166 A1 Apr. 2, 2015

(30) Foreign Application Priority Data

Sep. 30, 2013 (JP) ..... 2013-204743

(51) Int. Cl.
*G03G 15/20* (2006.01)

(52) U.S. Cl.
CPC ..... *G03G 15/2053* (2013.01); *G03G 15/2064* (2013.01)

(58) Field of Classification Search
USPC ..... 399/320, 329
See application file for complete search history.

(56) References Cited

U.S. PATENT DOCUMENTS

2011/0158718 A1 6/2011 Fujiwara et al.
2011/0188908 A1* 8/2011 Ishida ..... G03G 15/20 399/330
2011/0206406 A1* 8/2011 Suzuki ..... G03G 15/2064 399/90
2011/0206409 A1* 8/2011 Kondo ..... G03G 15/2017 399/92
2011/0211881 A1* 9/2011 Suzuki ..... G03G 15/2053 399/329
2011/0211882 A1* 9/2011 Suzuki ..... G03G 15/2053 399/329
2013/0071156 A1* 3/2013 Suzuki ..... G03G 15/2053 399/329

FOREIGN PATENT DOCUMENTS

JP 2011-095534 A 5/2011

* cited by examiner

*Primary Examiner* — Clayton E Laballe
*Assistant Examiner* — Warren K Fenwick
(74) *Attorney, Agent, or Firm* — Banner & Witcoff, Ltd.

(57) ABSTRACT

A fixing device includes a heating element extending in a first direction and configured to generate heat, a nip member extending along the heating element in the first direction and configured to receive radiant heat from the heating element, an endless belt extending along the heating element in the first direction, and a backup member extending along the heating element in the first direction. The endless belt is configured to rotate. The endless belt surrounds the heating element and the nip member. The backup member nips the endless belt in cooperation with the nip member. The nip member includes a main portion facing in a second direction perpendicular to the first direction and a particular holding portion holding the heating element.

17 Claims, 10 Drawing Sheets

FIXING DEVICE

CROSS-REFERENCE TO RELATED APPLICATION

This application claims priority from Japanese Patent Application No. 2013-204743 filed on Sep. 30, 2013, which is incorporated herein by reference in its entirety.

FIELD OF DISCLOSURE

The disclosure relates to a fixing device configured to thermally fix a developing agent image transferred to a sheet.

BACKGROUND

A known fixing device includes a cylindrical fixing belt, a heating element disposed inside the fixing belt, a nip member disposed inside the fixing belt, and a pressure roller placing the fixing belt between the pressure roller and the nip member. More specifically, in the fixing device, each end of the heating element is supported by a member (e.g., a member different from the nip member) disposed at each end of the fixing belt. A certain distance is provided between the heating element and the nip member.

In the fixing device, air between the heating element and the nip member, and the member supporting the heating element take the heat from the heating element. Therefore, improvements are required to heat the nip member promptly.

SUMMARY

The disclosure relates to a fixing device in which a nip member may be heated promptly.

According to an aspect of the disclosure, a fixing device may include a heating element extending in a first direction and configured to generate heat, a nip member extending along the heating element in the first direction and configured to receive radiant heat from the heating element, an endless belt extending along the heating element in the first direction, and a backup member extending along the heating element in the first direction. The endless belt is configured to rotate. The endless belt surrounds the heating element and the nip member. The backup member nips the endless belt in cooperation with the nip member. The nip member includes a main portion facing in a second direction perpendicular to the first direction and a particular holding portion holding the heating element.

With this structure, heat from the heating element may be transmitted promptly to the particular holding portion of the nip member, and thus the nip member may be heated promptly.

BRIEF DESCRIPTION OF THE DRAWINGS

Reference now is made to the following description taken in connection with the accompanying drawings.

DETAILED DESCRIPTION

Illustrative embodiments will be described referring to the accompanying drawings.

In the following description, the expressions "front", "rear", "top or upper (up)", "bottom or lower (down)", "right", and "left" are used to define the various parts when a laser printer 1 is disposed in an orientation in which it is intended to be used.

Figure 1:
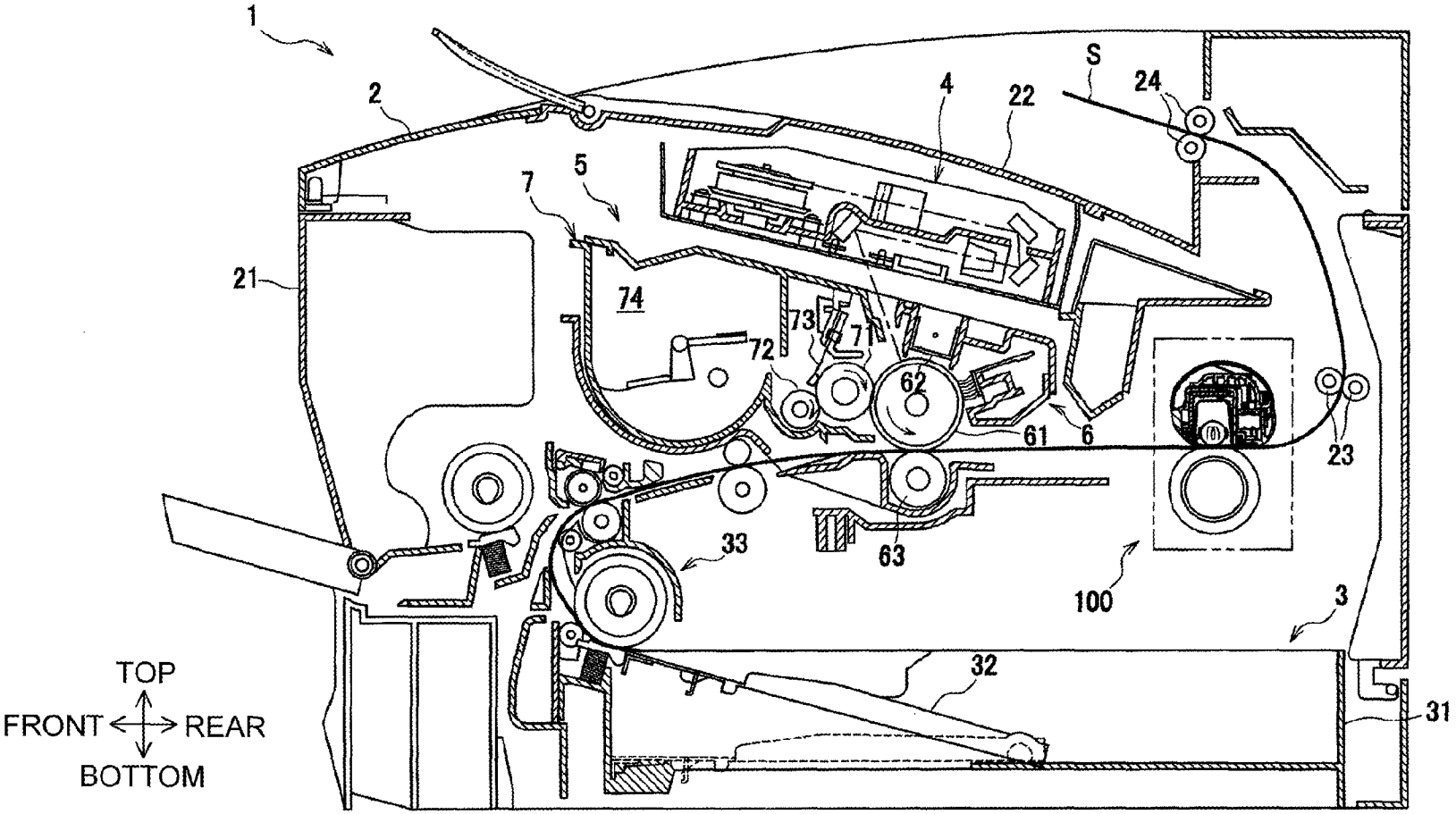
FIG. 1 is a schematic diagram of a laser printer comprising a fixing device in an illustrative embodiment according to one or more aspects of the disclosure.

As depicted in FIG. 1, the laser printer 1 may comprise a housing 2, in which a sheet feed unit 3 configured to feed a sheet S, an exposure device 4, a process cartridge 5 configured to transfer a toner image to the sheet S, and a fixing device 100 configured to thermally fix the toner image on the sheet S may be disposed.

The sheet feed unit 3 may be disposed at a lower portion of the housing 2. The sheet feed unit 3 may comprise a feed tray 31, a sheet lifting plate 32, and a sheet feeding mechanism 33. The sheets S accommodated in the feed tray 31 may be raised by the sheet lifting plate 32 and may be supplied by the sheet feeding mechanism 33 toward the process cartridge 5 (e.g., between a photosensitive drum 61 and a transfer roller 63).

The exposure device 4 may be disposed at an upper portion of the housing 2. The exposure unit 4 may comprise a laser light emitting unit (not shown), as well as a polygon minor, lenses, and reflecting mirrors, which are depicted without reference numerals. In the exposure device 4, laser light (see the dash-dot line) emitted from the laser light emitting unit based on image data may scan at high speed across the surface of the photosensitive drum 61 to expose the surface of the photosensitive drum 61 to light.

The process cartridge 5 may be disposed below the exposure device 4. The process cartridge 5 may be configured to be removably attached to the housing 2 through an opening exposed when a front cover 21 attached to the housing 2 is opened. The process cartridge 5 may comprise a drum unit 6 and a developing unit 7.

The drum unit 6 may comprise the photosensitive drum 61, a charger 62, and the transfer roller 63. The developing unit 7 may be configured to be removably attached to the drum unit 6. The developing unit 7 may comprise a developing roller 71, a supply roller 72, a thickness-regulation blade 73, and a toner storage 74 configure to store a developing agent, e.g., toner.

In the process cartridge 5, the surface of the photosensitive drum 61 may be uniformly charged by the charger 62. Thereafter, laser light from the exposure device 4 may scan at high speed across the surface of the photosensitive drum 61, and the surface of the photosensitive drum 61 may be exposed to light. An electrostatic latent image based on image data may be formed on the photosensitive drum 61. Toner in the toner storage 74 may be supplied through the supply roller 72 to the developing roller 71 and then may enter between the developing roller 71 and the blade 73. The toner may be carried on the developing roller 71 as a thin layer having a uniform thickness.

The toner carried on the developing roller 71 may be supplied from the developing roller 71 to the electrostatic latent image formed on the photosensitive drum 61. Thus, the electrostatic latent image may be visualized and a toner image may be formed on the photosensitive drum 61. Then, as the sheet S is conveyed between the photosensitive drum 61 and the transfer roller 63, the toner image on the photosensitive drum 61 may be transferred to the sheet S.

The fixing device 100 may be disposed behind the process cartridge 5. The toner image transferred to the sheet S may be thermally fixed to the sheet S while the sheet S passes through the fixing device 100. The sheet S on which the toner image has been thermally fixed may be discharged to a discharge tray 22 by feeding rollers 23 and 24.

Figure 2:
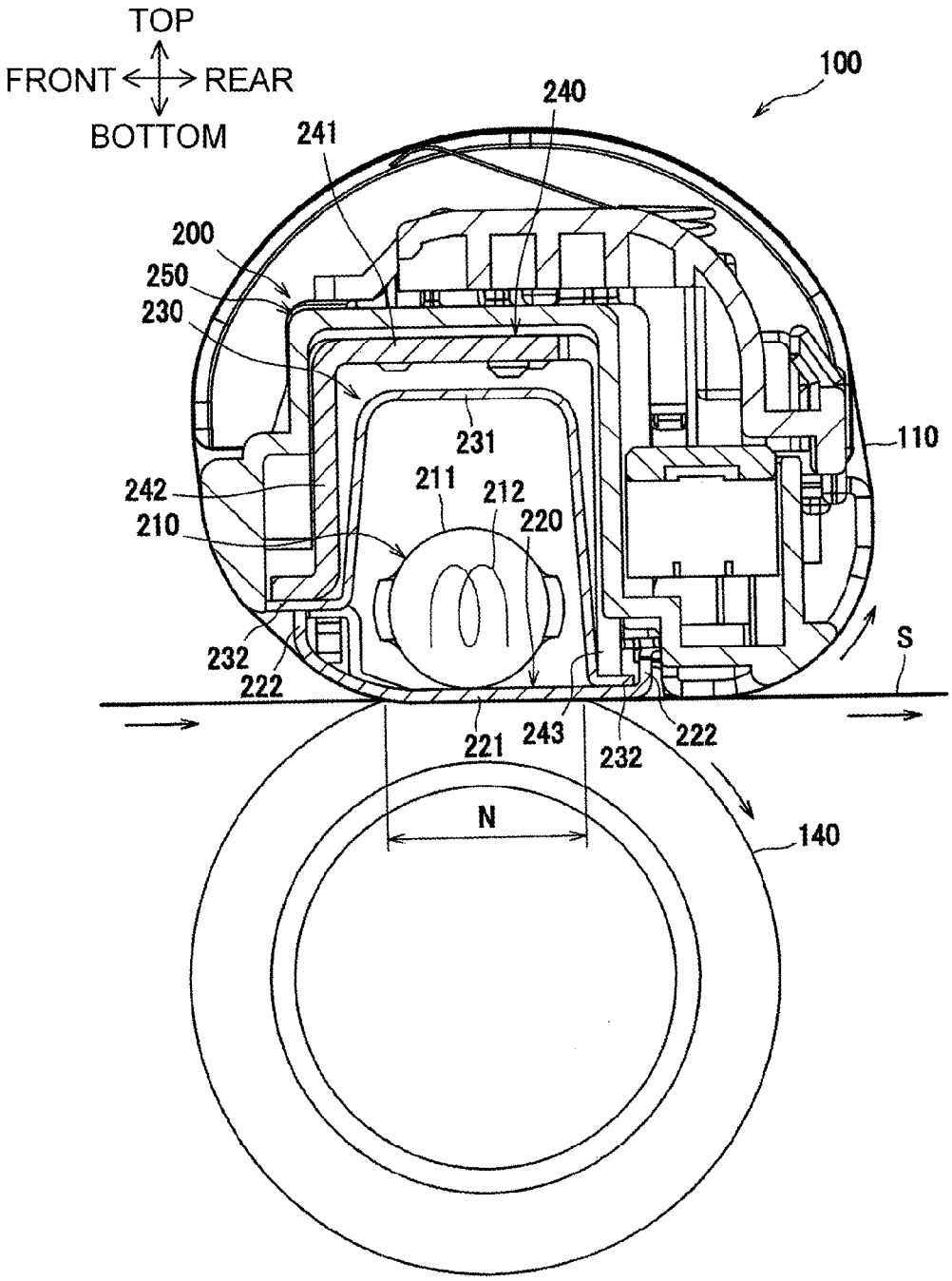
FIG. 2 is a cross-sectional view of the fixing device.

As depicted in FIG. 2, the fixing device 100 may comprise a rotatable, endless fixing belt 110, a heating unit 200 disposed inside the fixing belt 110 and configured to heat the fixing belt 110, and a backup member, e.g., a pressure roller 140, that may nip the fixing belt 110 in cooperation with the heating unit 200.

The fixing belt 110 may be configured to be heated by the heating unit 200. The fixing belt 110 may have heat resistance and flexibility. The rotation of the fixing belt 110 may be guided by a guide member, which is depicted without a reference numeral.

The pressure roller 140 may be elastically deformable. The pressure roller 140 may be disposed below the fixing belt 110 and the heating unit 200. A nip portion N may be formed when the pressure roller 140 is elastically deformed and nips the fixing belt 110 in cooperation with the heating unit 200 (particularly, a nip plate 220). In the illustrative embodiment, the heating unit 200 and the pressure roller 140 may be mutually brought into pressure contact with each other while one of them is urged toward the other.

The pressure roller 140 may be configured to rotate with drive force transmitted from a motor (not depicted) disposed in the housing 2. As the pressure roller 140 rotates, the fixing belt 110 may be rotated by a frictional force exerted between the pressure roller 140 and the fixing belt 110 (or the sheet S). As the sheet S having the toner image transferred is conveyed rearward between the pressure roller 140 and the fixing belt 110 that has been heated, the toner image may be thermally fixed to the sheet S.

The heating unit 200 may be configured to apply heat to toner on the sheet S via the fixing belt 110. The heating unit 200 may comprise a heating element, e.g., a halogen lamp 210, a nip member, e.g., a nip plate 220, a reflective member 230, a stay 240, and a cover member 250.

Figure 3:
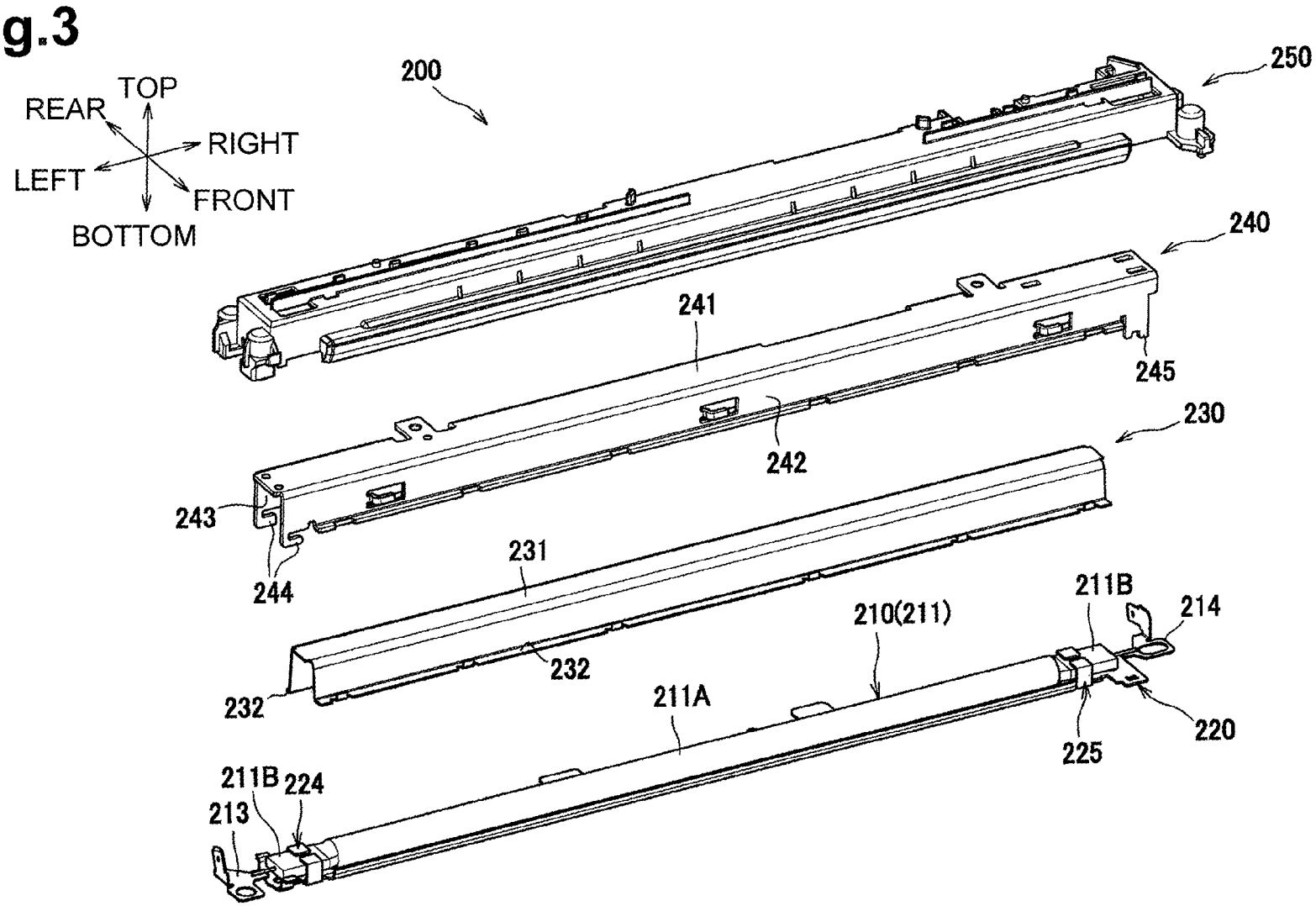
FIG. 3 is an exploded perspective view of a heat unit of the fixing device.

As depicted in FIGS. 2 and 3, the halogen lamp 210 may be a heater configured to generate heat with the application of electricity. The halogen lamp 210 may comprise a glass tube 211, a filament 212 provided in the glass tube 211, two terminals 213 and 214, each attached to a different end of the filament 212. The glass tube 211 may comprise a cylindrical portion 211A elongated along the left-right direction, and a sealed portion 211B integrally formed with the cylindrical portion 211A at each end of the cylindrical portion 211A. The sealed portion 211B may be formed in a flat plate shape. The sealed portion 211B may be formed smaller or thinner in the top-bottom direction than the cylindrical portion 211A, and greater or wider in the front-rear direction than the cylindrical portion 211A. The dimension of the sealed portion 211B in the top-bottom direction may be smaller than the dimension of the sealed portion 211B in the front-rear direction and the dimension of the sealed portion 211B in the left-right direction. The halogen lamp 210 may be held at the seal portions 211B by holding portions 224 and 225 of the nip plate 220, with the cylindrical portion 211A contacting the nip plate 220 (refer to FIG. 2).

The nip plate 220 may be a plate-shaped member configured to receive radiant heat from the halogen lamp 210. The nip plate 220 may be disposed such that the lower surface of the nip plate 220 may contact the inner peripheral surface of the fixing belt 110. The nip plate 220 may be formed by machining a material, e.g., an aluminum plate, having higher thermal conductivity than the steel stay 240 described later.

The reflective member 230 may be configured to reflect radiant heat (mainly emitted in the front-rear direction and in the upward direction) from the halogen lamp 210 toward the nip plate 220. The reflective member 230 may be disposed with a predetermined distance from the halogen lamp 210 to cover the halogen lamp 210.

As the reflective member 230 collects the radiant heat from the halogen lamp 210 to the nip plate 220, the radiant heat from the halogen lamp 210 may be efficiently used, and the nip plate 220 and the fixing belt 110 may be promptly heated.

Specifically, the reflective member 230 may be formed by bending, in a substantially U-shape, a material, e.g., an aluminum plate, having high infrared and far-infrared reflectance, and higher thermal conductivity than the stay 240. More specifically, the reflective member 230 may comprise a reflective portion 231 having a curved shape, e.g., a substantially U-shape in cross-sectional view, and a flange portion 232 extending outward in the front-rear direction from each lower end of the reflective portion 231. The reflective member 230 may be formed thinner than the stay 240.

The stay 240 may be configured to support each end of the nip plate 220 in the front-rear direction from a side opposite from the pressure roller 140. The stay 240 may be configured to receive a force exerted from the pressure roller 140 on the nip plate 220. The stay 240 may be formed by bending a metal plate, e.g., a steel plate, having relatively high stiffness, into a substantially U shape, in cross-sectional view, along the reflective member 230 (particularly, the reflective portion 231), so as to define an opening which is open toward the nip plate 220, as depicted in FIG. 2.

More specifically, the stay 240 may comprise an upper wall 241 disposed above the halogen lamp 210, as depicted in FIG. 2, and a front wall 242 and a rear wall 243 extending downward from the front and rear ends of the upper wall 241, respectively.

The front wall 242 may be disposed upstream of the halogen lamp 210 in the feeding direction of the sheet S. The lower end of the front wall 242 may sandwich, in cooperation with the nip plate 220, the flange portion 232 disposed on the front side of the reflective member 230. The front wall 242 may support the front end of the nip plate 220 from above.

The rear wall 243 may be disposed downstream of the halogen lamp 210 in the feeding direction of the sheet S. The lower end of the rear wall 243 may sandwich, in cooperation with the nip plate 220, the flange portion 232 disposed on the rear side of the reflective member 230. The rear wall 243 may support the rear end of the nip plate 220 from above.

The cover member 250 may be disposed outward of the stay 240 to cover the stay 240. The cover member 250 may have a substantially U-shape in cross-sectional view.

Figure 4:
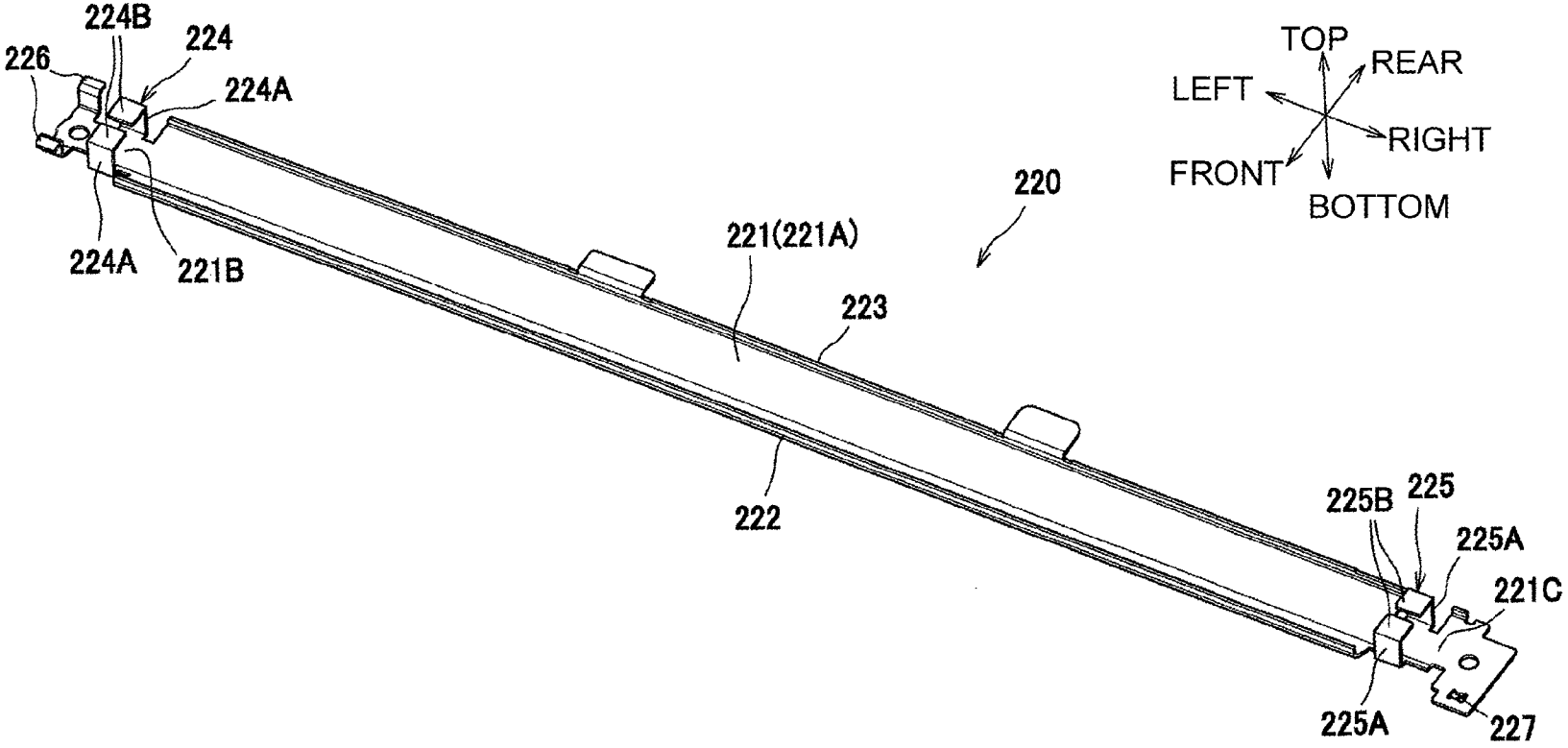
FIG. 4 is a perspective view of a nip plate of the heating unit.
Figure 5:
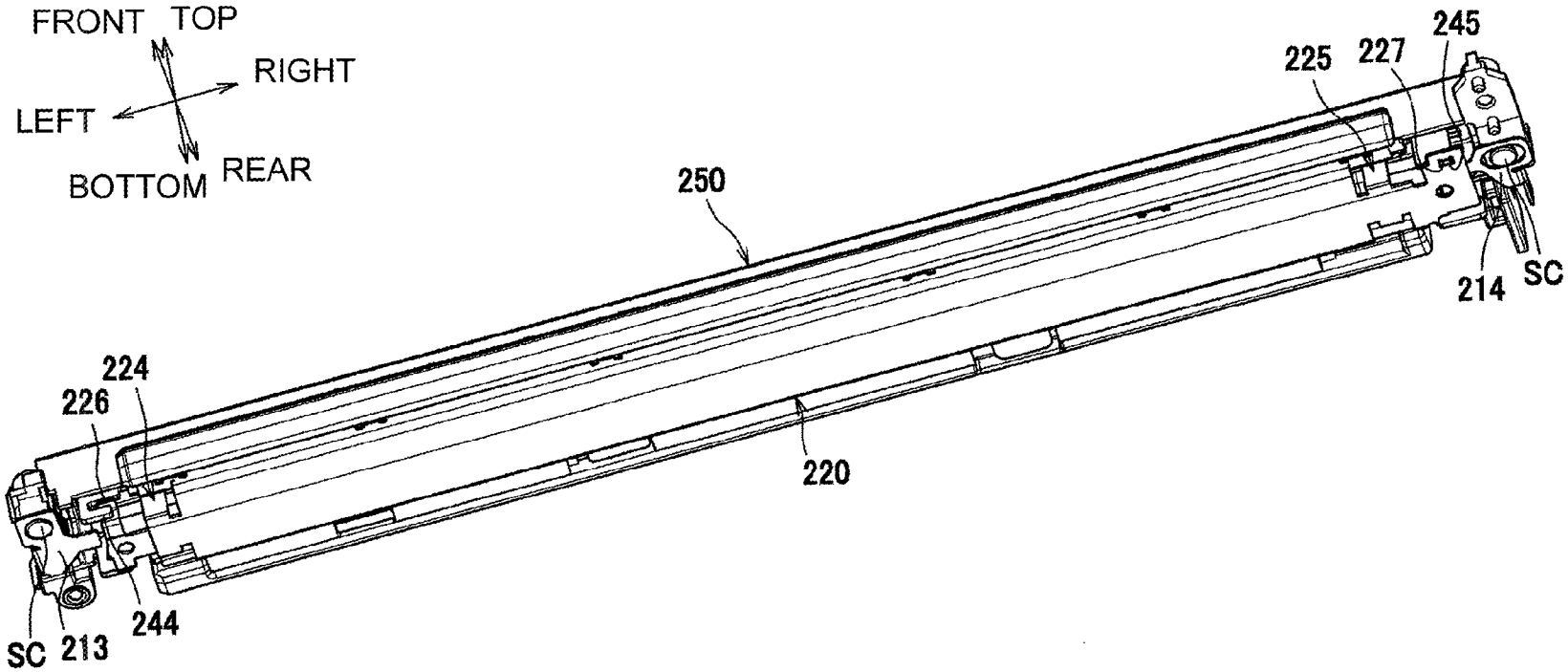
FIG. 5 is a perspective view of a cover member of the heating unit to which a halogen lamp of the heating unit is fixed.

As depicted in FIGS. 2-4, the nip plate 220 may comprise a generally plate-shaped main portion 221 extending perpendicular to the top-bottom direction, a curve portion 222 extending forwardly and upwardly, while curving, from the front end of the main portion 221, a bent portion 223 bent to protrude upward from the rear end of the main portion 221, and a first holding portion 224 and a second holding portion 225 disposed at a different end of the main portion 221 in the left-right direction (e.g., a width direction of the fixing belt 110). The main portion 221, the curve portion 222, the bent portion 223, the first holding portion 224 and the second holding portion 225 may be integrally formed.

The main portion 221 may be disposed below the halogen lamp 210 (e.g., the pressure roller 140 side). The main portion 221 may be formed longer than the glass tube 211 of the halogen lamp 210 in the left-right direction. More specifically, the main portion 221 may comprise a base portion 221A having substantially the same length as the cylindrical portion 211A of the glass tube 211, a first extending portion 221B extending leftward from the left end of the base portion 221A, and a second extending portion 221C extending rightward from the right end of the base portion 221A.

The base portion 221A may be formed such that a width thereof in the front-rear direction may be constant along the left-right direction.

The width of the first extending portion 221B in the front-rear direction may be smaller than that of the base portion 221A. The first holding portion 224 may be integrally formed with a right portion of the first extending portion 221B. A pair of engagement portions 226 may be integrally formed with a left end portion of the first extending portion 221B. The engagement portions 226 may be configured to engage with relevant hook portions 244 disposed on the left end portions of the stay 240.

The first holding portion 224 may be a portion configured to hold an end portion of the halogen lamp 210. More specifically the first holding portion 224 may be configured to hold the sealed portion 211B disposed on an end of the glass tube 211. The first holding portion 224 may comprise two first wall portions 224A and two second wall portions 224B.

The first holding portion 224 may be a portion to hold an end portion of the halogen lamp 210. More specifically the first holding portion 224 may be configured to hold the sealed portion 211B disposed on an end of the glass tube 211. The first holding portion 224 may comprise two first wall portions 224A and two second wall portions 224B.

Each first wall portion 224A may extend upward (e.g., opposite to the pressure roller 140) from a corresponding end of the first extending portion 221B of the main portion 221 in the front-rear direction (or in the rotation direction of the fixing belt 110). Distance between the first wall portions 224A may be substantially the same as the width of the sealed portion 211B of the glass tube 211 in the front-rear direction. Thus, the sealed portion 211B may be held between the first wall portions 224A.

Each second wall portion 224B may bend inwardly in the front-rear direction from a corresponding first wall portion 224A. Each second wall portion 224B may extend so as to come closer to each other. Each second wall portion 224B may face the first extending portion 221B of the main portion 221. Each second wall portion 224B may be configured to contact the sealed portion 211B of the glass tube 211, with the cylindrical portion 211A of the glass tube 211 contacting the base portion 221A of the main portion 221. Thus, the halogen lamp 210 may be held between the second wall portions 224B and the base portion 221A of the main portion 221. More specifically, the cylindrical portion 211A of the halogen lamp 210 may be supported at the base portion 221A. The upper surface of the sealed portion 211B of the halogen lamp 210 may be held at the second wall portions 224B.

The width of a left portion of the second extending portion 221C in the front-rear direction may be smaller than that of the base portion 221A. The width of a right portion of the second extending portion 221C in the front-rear direction may be greater than that of the left portion of the second extending portion 221C. The second holding portion 225 may be integrally formed with the left portion of the second extending portion 221C in the left-right direction. The right portion of the second extending portion 221C may have an engagement opening 227 configured to engage and hold an engagement protrusion 245 disposed at a right end portion of the stay 240.

The second holding portion 225 may comprise two first wall portions 225A similar to the first wall portions 224A of the first holding portion 224, and two second wall portions 225B similar to the second wall portions 224B of the of the first holding portion 224. The second holding portion 225 may be configured to hold the sealed portion 211B of the halogen lamp 210 between the first wall portions 225A and to hold the halogen lamp 210 (e.g., the cylindrical portion 211A and the sealed portion 211B) between the second wall portions 225B and the base portion 221A of the main portion 221. More specifically, the cylindrical portion 211A of the halogen lamp 210 may be supported at the base portion 221A. The upper surface the sealed portion 211B of the halogen lamp 210 may be held at the second wall portions 225B.

Further, a holding force between the first wall portions 225A of the second holding portion 225 may be smaller than a holding force between the first wall portions 224A of the first holding portion 224. A holding force between the second wall portions 225B of the second holding portion 225 and the base portion 221A may be smaller than a holding force between the second wall portions 224B of the first holding portion 224 and the base portion 221A.

Thus, an end of the glass tube 211 of the halogen lamp 210 in the left-right direction may be held by the first holding portion 224. The other end of the glass tube 211 of the halogen lamp 210 in the left-right direction may be held by the second holding portion 225 so as to allow the movement of the halogen lamp 210 in the left-right direction.

The halogen lamp 210 supported and held by the nip plate 220 with the holding portions 224 and 225 may be fixed to the cover member 250 by screws SC at each end of the halogen lamp 210 (specifically, at the terminals 213 and 214). More specifically, a hole for the screw SC formed on the left terminal 213 of the halogen lamp 210 may be round and may generally correspond to the diameter of the screw SC. Another hole for the screw SC formed on the right terminal 214 may be elongated in the left-right direction.

The following effects may be obtained in the illustrative embodiment.

The holding portions 224 and 225 configured to hold the halogen lamp 210 may be integrally formed with the nip plate 220. Heat from the halogen lamp 210 may be directly transmitted to the holding portions 224 and 225 of the nip plate 220. Therefore, the nip plate 220 may be heated promptly. As the cylindrical portion 211A of the halogen lamp 210 (e.g., a central portion of the halogen lamp 210 in the left-right direction) is brought into contact with the main portion 221 of the nip plate 220, heat from the halogen lamp 210 may be directly transmitted to the main portion 221 of the nip plate 220. Accordingly, the nip plate 220 may be heated more promptly. Further, as the nip plate 220 holds the halogen lamp 210, a member of the known fixing device configured to hold the heating element may be unnecessary. Thus, cost reduction may be achieved.

Each end of the halogen lamp 210 may be held by the holding portion 224 and 225. Therefore, the halogen lamp 210 may be stably held by the holding portions 224 and 225. Heat from the halogen lamp 210 may be transmitted to the main portion 221 of the nip plate 220 from the holding portions 224 and 225. Therefore, as compared with a case in which, for example, one, holding portion is provided, the nip plate 220 may be heated more promptly.

One end of the halogen lamp 210 may be held by the first holding portion 224. The other end of the halogen lamp 210 may be held by the second holding portion 225 so as to allow the movement of the halogen lamp 210 in the left-right direction. Therefore, thermal expansion of the halogen lamp 210 or the nip plate 220 in the left-right direction may be absorbed or relieved.

This disclosure is not limited to the above-described illustrative embodiment, but may be applied to, for example, the following modifications. Like reference numerals denote like corresponding parts and detailed description thereof with respect to the following modifications may be omitted herein.

In the above-described illustrative embodiment, the halogen lamp 210 may be held in the top-bottom direction between the second wall portions 224B and 225B and the base portion 221A disposed at a different position from the second wall portions 224B and 225B in the left-right direction. However, the disclosure might not be limited thereto. For example, the halogen lamp 210 may be held in an upward direction between the second wall portions 224B and 225B and a portion of the main portion 221 of the nip plate 220 disposed at the same position as the second wall portions 224B and 225B in the left-right direction, as depicted in, for example, FIG. 6.

Figure 6:
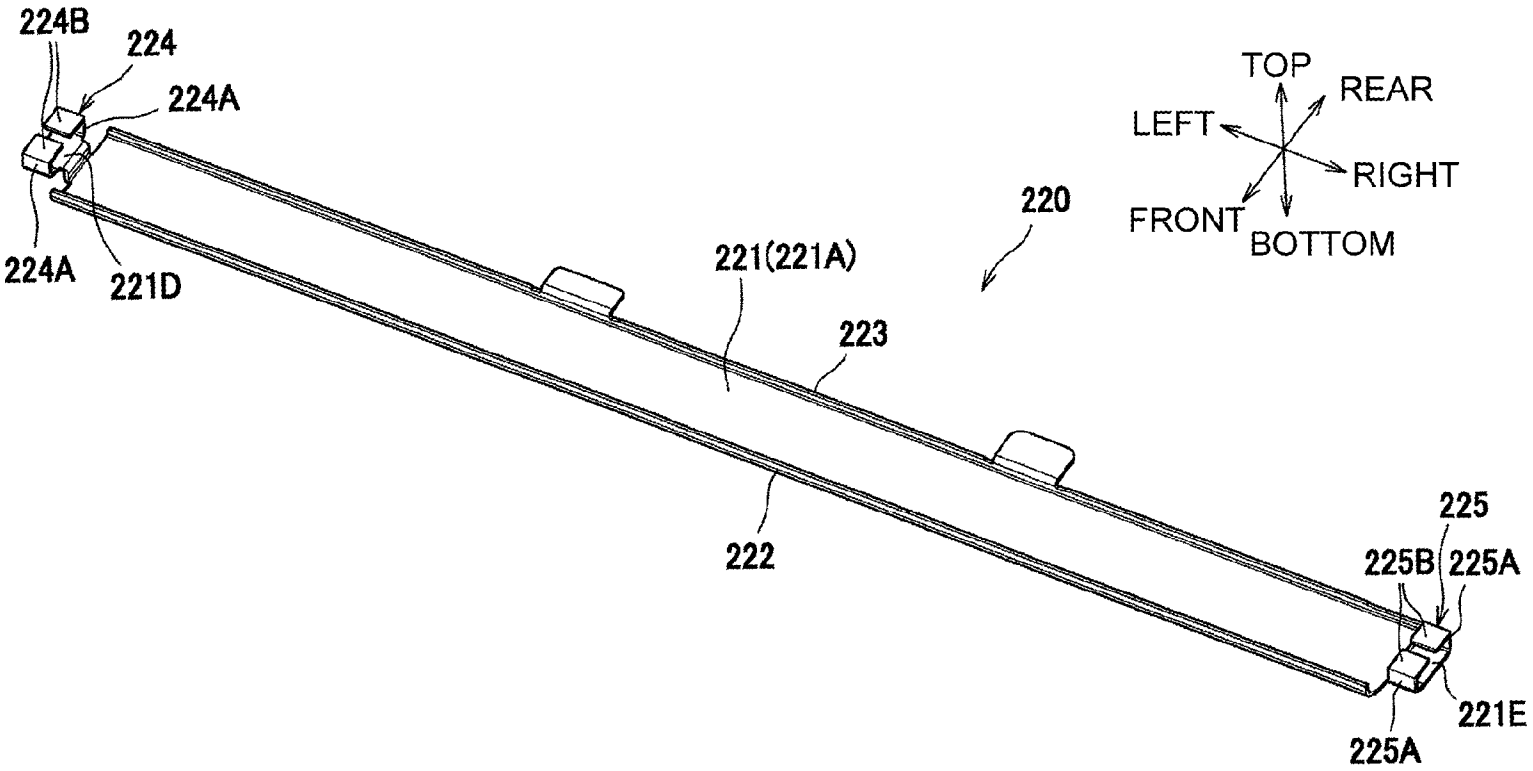
FIG. 6 is a perspective view of a nip plate according to a first modification of the disclosure.

In the structure depicted in FIG. 6, the main portion 221 may comprise a base portion 221A, and extension portions 221D and 221E bent upward from each end of the base portion 221A in the left-right direction and then extending outward in the left-right direction. The extension portions 221D and 221E may be formed with the first holding portion 224 and the second holding portion 225, respectively, similar to the above-described illustrative embodiment.

Figure 7:
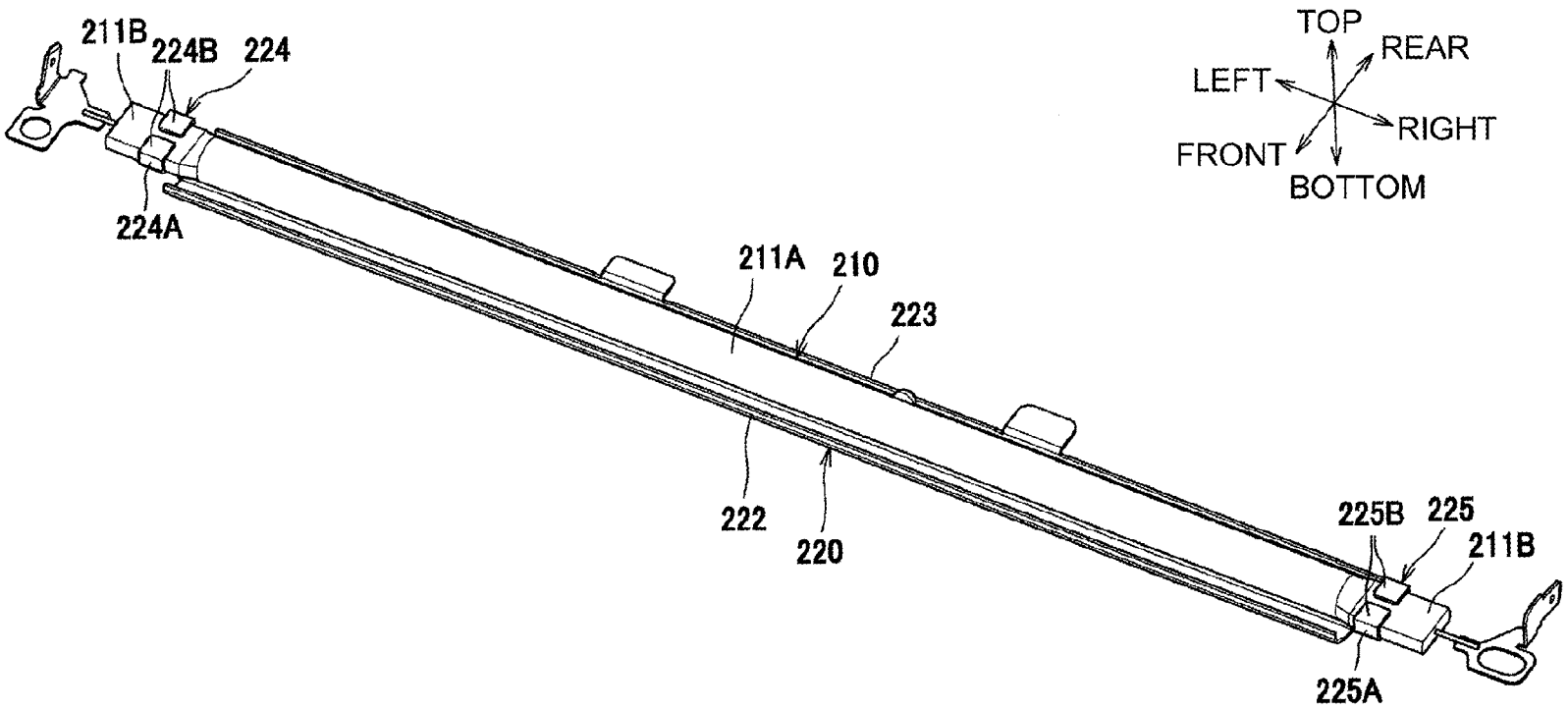
FIG. 7 is a perspective view of the nip plate according to the first modification to which the halogen lamp is attached.

In such a structure, as depicted in FIGS. 6 and 7, the left sealed portion 211B of the halogen lamp 210 may be held in the top-bottom direction between the left extension portion 221D and the second wall portions 224B opposing the left extension portion 221D in the top-bottom direction. The right sealed portion 211B of the halogen lamp 210 may be held in the top-bottom direction between the right extension portion 221E and the second wall portions 225B opposing the right extension portion 221E in the top-bottom direction.

In the structure depicted in FIG. 6, the cylindrical portion 211A of the glass tube 211 (e.g., a central portion of the halogen lamp 210 in its axial direction) and the main portion 221 of the nip plate 220 (e.g., the base portion 221A) might not have to contact each other as in the above-described illustrative embodiment. A central portion of the halogen lamp 210 in its axial direction may be slightly separated from the nip plate 220. In this case, the distance between the central portion of the halogen lamp 210 in its axial direction and the nip plate 220 may be preferably within 1 mm, more preferably within 0.5 mm. In other words, the halogen lamp 210 may be spaced apart from the nip plate 220 by at most 1 mm, more preferably at most 0.5 mm.

In the above-described illustrative embodiment, the nip plate 220 may be provided with the engagement portions 226 and the engagement opening 227 for engagement with the stay 240. However, the disclosure might not be limited thereto. For example, as depicted in FIG. 6, the nip plate 220 might not have to be provided with a portion for engagement with the stay 240, as in the above-described illustrative embodiment.

Figure 8:
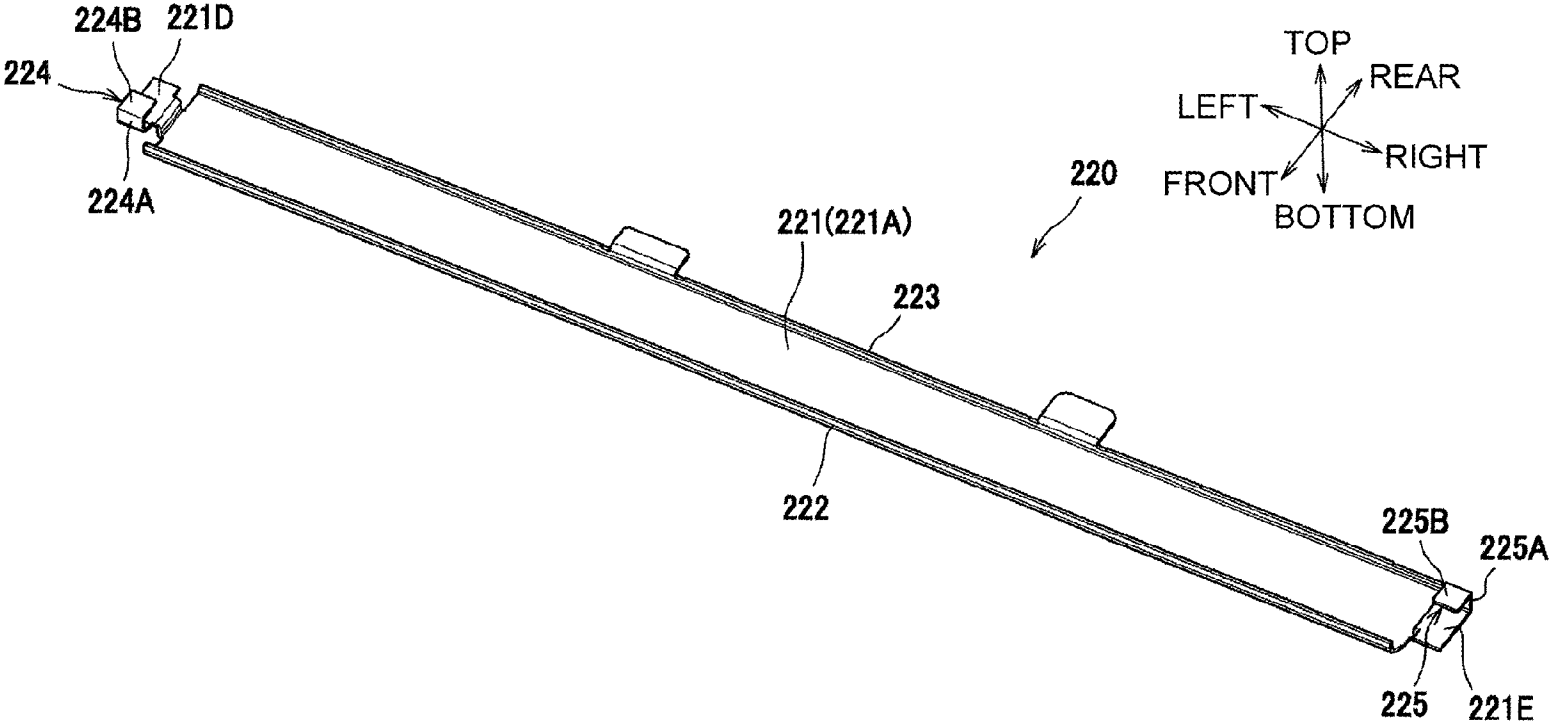
FIG. 8 is a perspective view of a nip plate according to a second modification of the disclosure.

In the above-described illustrative embodiment and modification, each holding portion 224 and 225 may comprise two first wall portions 224A and 225A and two second wall portion 224B and 225B, respectively. However, the disclosure might not be limited thereto. For example, as depicted in FIG. 8, each holding portion 224 and 225 may comprise one first wall portion 224A and 225A, and one second wall portion 224B and 225B, respectively. The structure depicted in FIG. 8 may be a modification of a portion of the structure depicted in FIG. 6.

More specifically, in the structure depicted in FIG. 8, the first wall portion 224A of the first holding portion 224 may be disposed at the front end of the left extension portion 221D (e.g., the upstream end in the rotation direction of the fixing belt 110). The second wall portion 224B may protrude rearward (e.g., toward the downstream side in the rotation direction of the fixing belt 110) from the first wall portion 224A. The first wall portion 225A of the second holding portion 225 may be disposed at the rear end of the right extension portion 221E (e.g., the downstream end in the rotation direction of the fixing belt 110). The second wall portion 225B may protrude forward (e.g., toward the upstream side in the rotation direction of the fixing belt 110) from the first wall portion 225A.

In this case also, each holding portion 224 and 225 may favorably hold the halogen lamp 210. The positions of the first holding portion 224 and the second holding portion 225 in the left-right direction might not be limited to those depicted in FIG. 8 but may be reversed.

Figure 9:
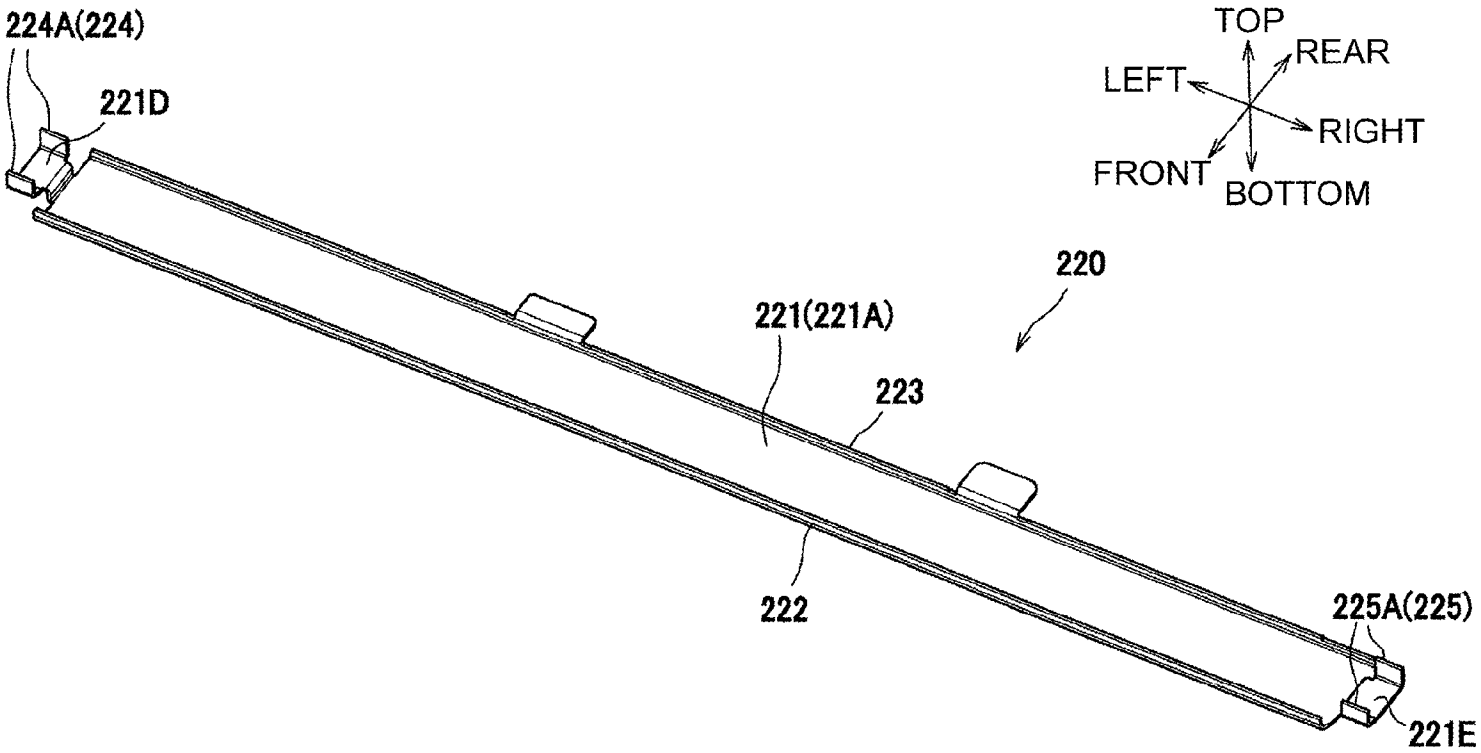
FIG. 9 is a perspective view of a nip plate according to a third modification of the disclosure.

As depicted in FIG. 9, each holding portion 224 and 225 may comprise two first wall portions 224A and 225A, respectively. The structure depicted in FIG. 9 may be a modification of a portion of the structure depicted in FIG. 6.

More specifically, in the structure depicted in FIG. 9, each holding portion 224 and 225 may comprise a pair of the first wall portions 224A and 225A, respectively, extending upward from the front and rear ends of each extension portion 221D and 221E (e.g., the upstream end and the downstream end in the rotation direction of the fixing belt 110, respectively). In this structure, the left and right sealed portions 211B of the halogen lamp 210 may be held between the first wall portions 224A and 225A of the holding portions 224 and 225, respectively. In this case also, each holding portion 224 and 225 may favorably hold the halogen lamp 210.

Figures 10A, 10B:
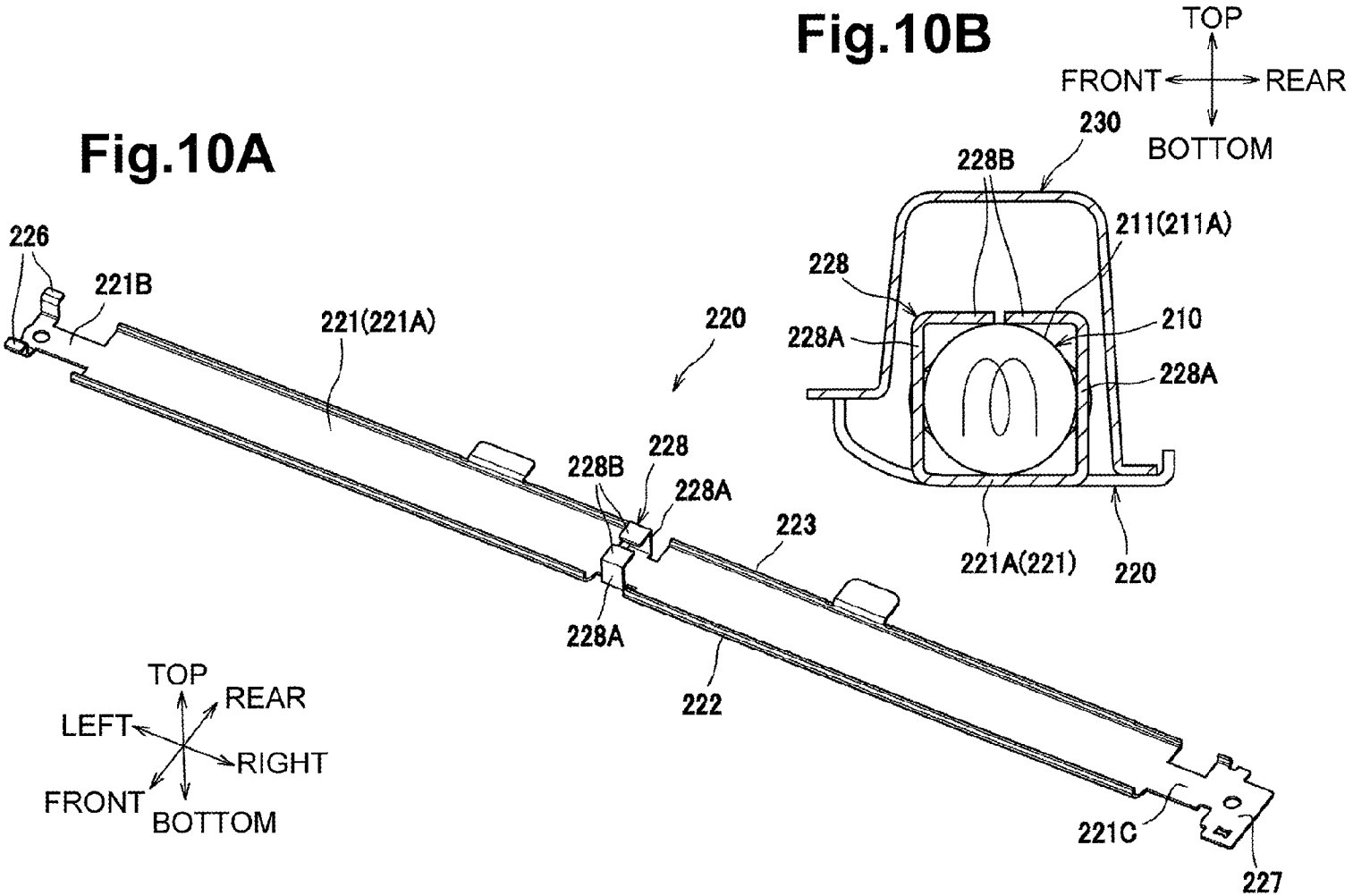
FIG. 10A is a perspective view of a nip plate according to a fourth modification of the disclosure.
FIG. 10B is a cross-sectional view of the nip plate according to the fourth modification of the disclosure.

In the above-described illustrative embodiment and modifications, the nip plate 220 may comprise two holding portions 224 and 225. However, the disclosure might not be limited thereto. For example, as depicted in FIGS. 10A and 10B, the nip plate 220 may comprise one holding portion 228 at a central portion thereof in the left-right direction. The structure of FIGS. 10A and 10B may be a modification of the structure of FIG. 4.

More specifically, the holding portion 228 may comprise two first wall portions 228A similar to the first wall portions 224A of the above-described illustrative embodiment and two second wall portions 228B similar to the second wall portions 224B of the above-described illustrative embodiment. In this structure, the width, in the front-rear direction, of the central portion of the base portion 221A in the left-right direction may be smaller than that of the other portions of the base portion 221A.

Each first wall portion 228A may extend upward from the front and rear ends of the central portion of the base portion 221A having a smaller width. The first wall portions 228A may be configured to hold the cylindrical portion 211A of the halogen lamp 210 in the front-rear direction. Each second wall portion 228B may extend from the upper end of the corresponding first wall portion 228A so as to come closer to each other. Each second wall portion 228B may face the central portion of the base portion 221A in the top-bottom direction.

The cylindrical portion 211A of the halogen lamp 210 may be held between the second wall portions 228B and the central portion of the base portion 221A in the top-bottom direction. In such a structure, the holding portion 228 disposed at a central portion of the nip plate 220 may hold the halogen lamp 210 in a balanced manner.

In the structure of FIGS. 10A and 10B, the holding portion 228 might not necessarily comprise the second wall portions 228B but may comprise, for example, two first wall portions 228A without the second wall portions 228B. In this case also, the first wall portions 228A may hold the halogen lamp 210.

In the above-described illustrative embodiment and modifications, the halogen lamp 210 may be illustrated as an example of the heating element. However, the disclosure might not be limited thereto. For example, the heating element may comprise a carbon heater.

In the above-described illustrative embodiment and modifications, the nip plate 220 may be illustrated as an example of the nip member. However, the disclosure might not be limited thereto. The nip member may comprise, for example, a thick member that might not have a plate-like shape.

In the above-described illustrative embodiment, the pressure roller 140 may be illustrated as an example of the backup member. However, the disclosure might not be limited thereto. The backup member may comprise, for example, a belt-like pressing member.

While the disclosure has been described in detail referring to the specific embodiment thereof, this is merely an example, and various changes, arrangements and modifications may be applied therein without departing from the spirit and scope of the disclosure.

What is claimed is:

1. A fixing device comprising:

a heating element extending in a first direction and configured to generate heat;

a nip member extending along the heating element in the first direction and configured to receive radiant heat from the heating element;

an endless belt extending along the heating element in the first direction, the endless belt being configured to rotate, the endless belt surrounding the heating element and the nip member; and a backup member extending along the heating element in the first direction, the backup member nipping the endless belt in cooperation with the nip member, wherein the nip member includes a main portion facing in a second direction perpendicular to the first direction and extending along the heating element in the first direction, and a first holding portion holding the heating element and contacting a surface of the heating element facing away from the main portion.

2. The fixing device according to claim 1, wherein the first holding portion includes a first wall portion facing in a third direction opposite to the second direction, and wherein the heating element is held by the first wall portion of the first holding portion and the main portion.

3. The fixing device according to claim 1, wherein the first holding portion includes a pair of first wall portions facing in a third direction opposite to the second direction, and wherein the heating element is held by the pair of first wall portions of the first holding portion and the main portion.

4. The fixing device according to claim 1, wherein the first holding portion includes a first wall portion extending in the second direction, and wherein the heating element is held by the first wall portion of the first holding portion and the main portion.

5. The fixing device according to claim 1, wherein the first holding portion includes a pair of first wall portions facing each other and extending from the main portion in the second direction, and wherein the heating element is held between the pair of first wall portions.

6. The fixing device according to claim 1, wherein the first holding portion includes a first wall portion extending in the second direction from the main portion and a second wall portion being bent from the first wall portion and facing in a third direction opposite to the second direction, and wherein the heating element is held by the second wall portion and the main portion.

7. The fixing device according to claim 1, wherein the first holding portion includes a first first wall portion and a second first wall portion, and a first second wall portion and a second second wall portion, wherein the first first wall portion and the second wall portion face each other and extend from the main portion in the second direction, wherein the first second wall portion is bent from the first first wall portion and faces in a third direction opposite to the second direction, and the second second wall portion is bent from the first second wall portion and faces in the third direction, and wherein the heating element is held by the first second wall portion, the second second wall portion, and the main portion.

8. The fixing device according to claim 1, wherein the first holding portion of the nip member is disposed at an end portion of the nip member in the first direction.

9. The fixing device according to claim 1, wherein the first holding portion of the nip member is disposed at a central portion of the nip member in the first direction.

10. The fixing device according to claim 1, wherein the first holding portion is above the main portion.

11. The fixing device according to claim 10, wherein the heating element is spaced from the main portion at most 1 mm in a third direction opposite to the second direction.

12. The fixing device according to claim 11, wherein the heating element is spaced from the main portion at most 0.5 mm in the third direction.

13. The fixing device according to claim 1, wherein the nip member further includes a second holding portion spaced apart from the first holding portion in the first direction, wherein each of the first holding portion and the second holding portion includes a first wall portion facing in a third direction opposite to the second direction, and wherein the heating element is held by the main portion and the first wall portion of each of the first holding portion and the second holding portion.

14. The fixing device according to claim 1, wherein the nip member further includes a second holding portion spaced apart from the first holding portion in the first direction, wherein each of the first holding portion and the second holding portion includes a first wall portion extending in the second direction, and wherein the heating element is held by the main portion and the first wall portion of each of the first holding portion and the second holding portion.

15. The fixing device according to claim 1, wherein the nip member further includes a second holding portion spaced apart from the first holding portion in the first direction, wherein each of the first holding portion and the second holding portion includes a pair of first wall portions facing each other and extending from the main portion in the second direction, and wherein the heating element is held between the pair of first wall portions of each of the first holding portion and the second holding portion.

16. The fixing device according to claim 1, wherein the nip member further includes a second holding portion spaced apart from the first holding portion in the first direction, wherein each of the first holding portion and the second holding portion includes a first wall portion extending in the second direction from the main portion and a second wall portion being bent from the first wall portion and facing in a third direction opposite to the second direction, and wherein the heating element is held by the main portion and the second wall portion of each of the first holding portion and the second holding portion.

17. The fixing device according to claim 1, wherein the nip member further includes a second holding portion spaced apart from the first holding portion in the first direction, wherein each of the first holding portion and the second holding portion includes a first first wall portion and a second first wall portion, and a first second wall portion and a second second wall portion, wherein the first first wall portion and the second wall portion face each other and extend from the main portion in the second direction, wherein the first second wall portion is bent from the first first wall portion and faces in a third direction opposite to the second direction, and the second second wall portion is bent from the first second wall portion and faces in the third direction, and wherein the heating element is held by the main portion and the second wall portion of each of the first holding portion and the second holding portion.

* * * * *